US010875691B1

(12) United States Patent
Sickenberger et al.

(10) Patent No.: US 10,875,691 B1
(45) Date of Patent: Dec. 29, 2020

(54) CABLE TIE WITH MULTI-SLOT HEAD FOR ATTACHMENTS

(71) Applicant: U.S. Army Edgewood Chemical Biological Center, APG, MD (US)

(72) Inventors: David W Sickenberger, Bel Air, MD (US); Clarence D. Brown, Havre de Grace, MD (US)

(73) Assignee: The United States of America As Represented by The Secretary Of The Army, Washington, DC (US)

( * ) Notice: Subject to any disclaimer, the term of this patent is extended or adjusted under 35 U.S.C. 154(b) by 0 days.

(21) Appl. No.: 16/105,130

(22) Filed: Aug. 20, 2018

Related U.S. Application Data

(62) Division of application No. 14/848,695, filed on Sep. 9, 2015, now Pat. No. 10,053,268.

(51) Int. Cl.
*B65D 63/10* (2006.01)
*B65D 63/18* (2006.01)

(52) U.S. Cl.
CPC ..... *B65D 63/1063* (2013.01); *B65D 63/18* (2013.01); *B65D 2563/101* (2013.01); *B65D 2563/108* (2013.01)

(58) Field of Classification Search
CPC ..... B65D 63/1063; B65D 63/18; B65D 2563/101; B65D 2563/108; Y10T 24/1498
See application file for complete search history.

(56) References Cited

U.S. PATENT DOCUMENTS 5,395,343 A * 3/1995 Iscovich ..... A61M 25/02 128/DIG. 26
6,151,761 A * 11/2000 Thompson ..... E05B 75/00 24/16 PB
6,332,248 B1 * 12/2001 Daniggelis ..... B65D 63/1072 24/16 PB
6,507,979 B1 * 1/2003 Thompson ..... E05B 75/00 24/16 PB
7,131,168 B2 * 11/2006 Pangallo ..... B65D 63/1063 24/16 PB
8,739,387 B1 * 6/2014 Frishberg ..... B23P 19/04 29/525.01

* cited by examiner

*Primary Examiner* — Robert Sandy
(74) *Attorney, Agent, or Firm* — Ulysses John Biffoni

(57) ABSTRACT

A new and improved cable tie includes a core cable tie having a multi-slot head and a set of attachments that are not integrally formed with the core cable tie. A user can combine one or more attachments with a core cable tie to form a cable tie assembly. As such, a core cable tie can be modified with one or more attachments that are specific to a desired capability or configuration. This results in improved strength and cost savings in that the same core cable tie can be used for multiple applications. The user only adds attachments, such as finger or hand pulls, based on the needs of a specific situation.

20 Claims, 16 Drawing Sheets

CABLE TIE WITH MULTI-SLOT HEAD FOR ATTACHMENTS

CROSS-REFERENCE TO RELATED APPLICATIONS

This application is a divisional of application Ser. No. 14/848,695 filed on Sep. 9, 2015, now U.S. Pat. No. 10,053,268 which is commonly assigned.

GOVERNMENT INTEREST

The invention described herein may be used, manufactured, and/or licensed by or for the United States Government.

FIELD OF THE INVENTION

The invention relates generally to cable ties and more particularly to cable ties with customizable configurations and attachments.

BACKGROUND

Cable ties, also known as tie wraps, are well known fastening devices. In most embodiments, they are typically formed from a single piece of plastic having a head and an attached strap. A representative example is shown in FIG. 1. A prior art cable tie 10 includes a head 12 with a slot 14 containing a pawl mechanism. An elongate strap 16 includes a notched surface that interacts with a pawl mechanism in slot 14 when the tapered end 18 of strap 16 is inserted into slot 14. Strap 16 is designed so that there is a ratcheting effect when tapered end 18 is inserted into slot 14 and engages the pawl mechanism. The ratcheting effect prevents the strap from being pulled out once inserted. This technology is taught by several sources, for example, Munch, U.S. Pat. No. 4,214,349.

The cable tie of Munch has been improved to incorporate interfaces to other surfaces and objects. Slank (US 2006/0012199) for example, discloses a cable tie with a handle for transporting articles integrated into the cable tie. Handles in a variety of shapes are shown, including oval, T-shaped and rectangular. In each case, the handle is manufactured as an integral part of the cable tie. In other words, a cable tie having an integral T-shaped handle (Slank, FIG. 1E) is a separate product from the cable tie having a rectangular handle (Slank, FIG. 3A).

Geiger (U.S. Pat. No. 7,774,905) discloses adding a second head onto the strap. A representation of this type of cable tie is shown in FIG. 2. A second head 20 contains a slot 22 having a pawl mechanism similar to slot 14 of head 12. Second head 20 provides a mechanism such that, after securing items by inserting strap 16 into slot 14 of head 12, strap 16 may then be passed around additional items and through slot 22 in second head 20. Second head 20 is attached to first head 12 by an attachment point 24 that is flexile or robust. In either case, attachment point 24 has a width and thickness that is approximately the same as strap 16 and much smaller than either head. This creates a weakness in the cable tie since it is easy for the tie to break at attachment point 24.

Thus, a need exists for a cable tie that offers cost and performance improvements over existing designs. The cable tie can be modified with one or more attachments and thus, flexibly used in a wide variety of situations. There is a further need for an improved cable tie head that provides greater strength.

SUMMARY

A cable tie according to the present invention includes a core cable tie and a set of attachments that are not integrally formed with the core cable tie. Each attachment becomes part of a cable tie assembly only after a user attaches it to a core cable tie. As such, a core cable tie can be modified with one or more attachments that are specific to a desired capability or configuration. This results in cost savings from the fact that the same core cable tie can be used for multiple applications. The user only adds attachments, such as finger or hand pulls, based on the needs of a specific situation.

According to the present invention, many types of attachments are separate parts capable of attaching to a core cable tie. These attachments include handles, pull tabs, surfaces that can be nailed or screwed, surfaces for labeling, and even other cable ties. Attachments can be fabricated out of the same material used for the cable tie or some other material based on the end application.

A core cable tie according to the present invention includes a single head with two or more slots containing pawl mechanisms integrally formed in the single head. This single head design greatly improves the strength of device given that the pawl attachment points are now contained with a solid piece and not separated by other structures. In an embodiment, the core cable tie maximizes the holding strength between the two slots and also allows one to easily configure the orientation of the slots within a single head. As an example, the slots can be designed so the straps can be inserted into orthogonal slots and the overall strength of the head is not impacted.

The invention in one implementation encompasses an apparatus including an elongated strap having a length, a width and a thickness, the strap further having a plurality of longitudinally-spaced teeth along a surface of the strap; and a head integrally formed with the strap, the head formed of a solid shape having a length in line with the longitudinal axis of the strap and a width and thickness larger than the width and thickness of the strap, the head further including two or more slots through the width or thickness of the head, each slot further having a pawl for cooperating with the teeth when the strap is inserted into said slot, and the two or more slots positioned in any orientation.

In a further embodiment, the invention encompasses an elongated strap having a length, a width, a thickness and a plurality of longitudinally-spaced teeth along a surface of the strap; a head integrally formed with the strap, the head formed of a solid shape having a length in line with the longitudinal axis of the strap and a width and thickness larger than the width and thickness of the strap, the head further including two or more slots through the width or thickness of the head, each slot further comprising a pawl for cooperating with the teeth when the strap is inserted into the slot; and an attachment including an attachment strap having a length, a width and a thickness, said strap further having a plurality of longitudinally-spaced teeth along a surface of the attachment strap, the attachment further comprising a functional element attached to the attachment strap, the attachment strap inserted into a slot in the head such that a pawl in the slot cooperates with the teeth on the attachment strap.

In a further embodiment, the invention encompasses an attachment for use with a cable tie, including an attachment strap having a length, a width and a thickness, the strap further including a plurality of longitudinally-spaced teeth along a surface of the attachment strap for engaging with a slot containing a pawl in a cable tie; and a functional element attached to the attachment strap.

DESCRIPTION OF THE DRAWINGS

Features of example implementations of the invention will become apparent from the description, the claims, and the accompanying drawings in which:

DETAILED DESCRIPTION

If used and unless otherwise stated, the terms "upper," "lower," "front," "back," "over," "under," and similar such terms are not to be construed as limiting the invention to a particular orientation. Instead, these terms are used only on a relative basis.

Figure 1:
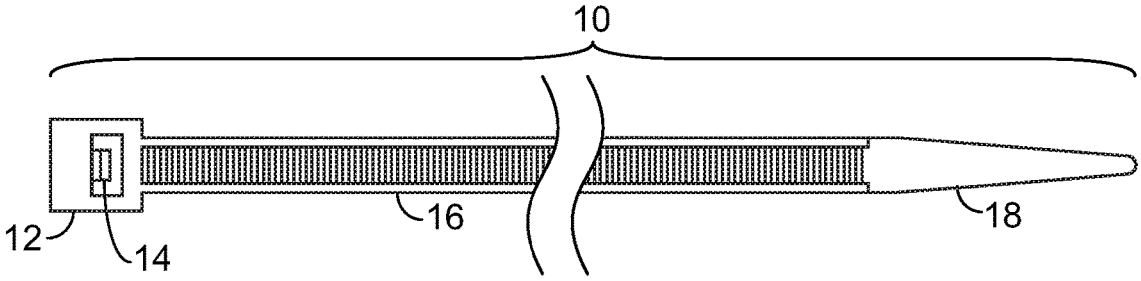
FIG. 1 PRIOR ART
FIG. 1 shows a prior art cable tie.
Figure 3A:
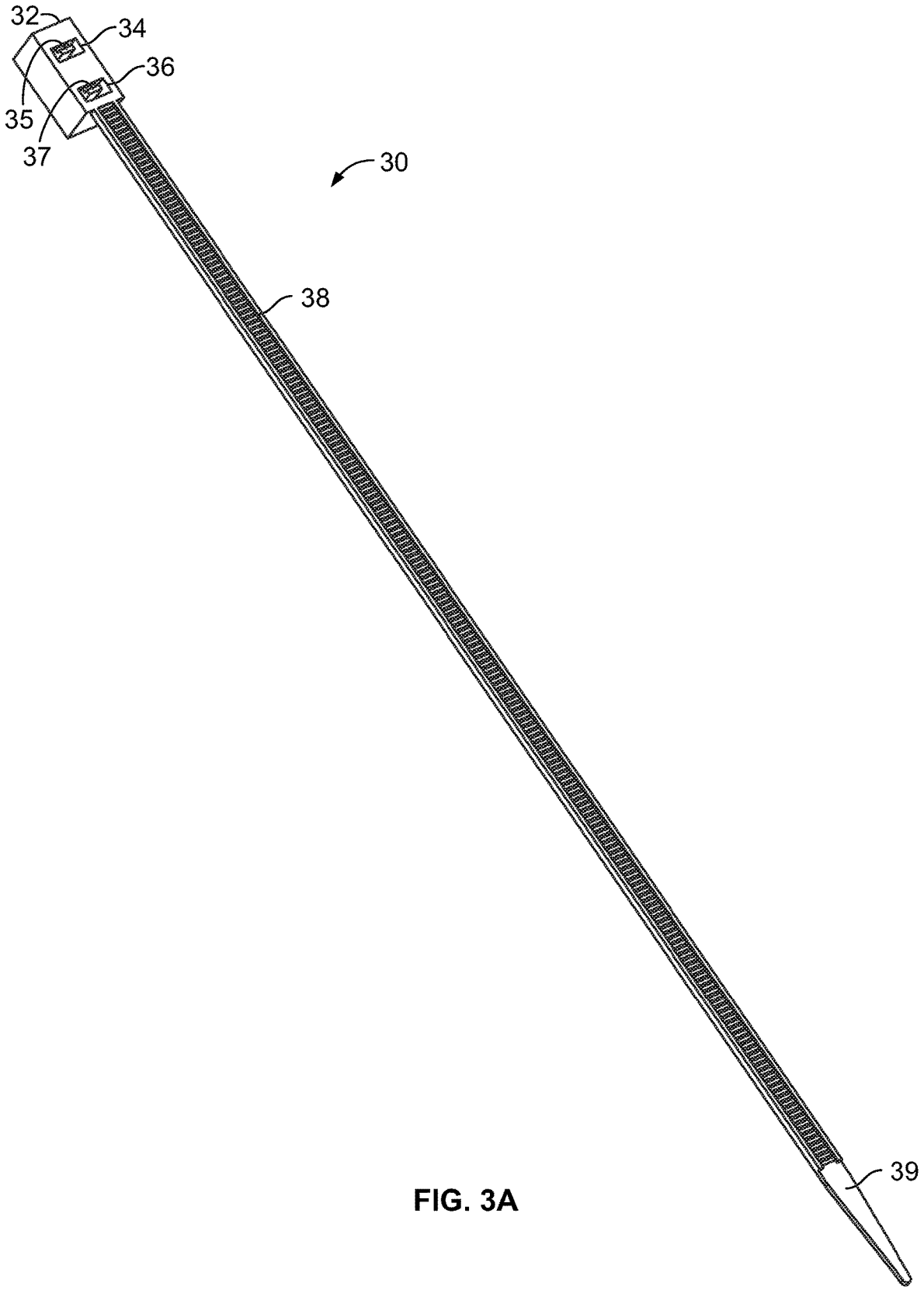
FIG. 3A illustrates a core cable tie according to the present invention.

FIG. 3A illustrates a core cable tie 30 according to the present invention. Cable tie 30 includes head 32 and elongate strap 38. Head 32 includes a first slot 34 incorporating a pawl mechanism 35 and a second slot 36 incorporating a pawl mechanism 37. Strap 38 includes a series of notches or indentations on one surface that engage with pawl mechanisms 35 or 37 as understood by one of ordinary skill in the art. In a typical use, the tip 39 of strap 38 is inserted into slot 36, engaging pawl 37, thus functioning as a standard cable tie as shown in FIG. 1. Slot 34 is oriented in the same direction as slot 36 so that strap 38 could also be inserted into pawl 34. Regardless of which of slots 34 and 36 receives strap 38, the unused slot forms an interface to add attachments that mate with the pawls' ratcheting action as will be described further below.

FIG. 38 illustrates a core cable tie similar to that shown in FIG. 3A. Single head 32*a* has generally the same dimensions as head 32 of FIG. 3A, but there is a greater distance between slots 34*a* and 36*a* in FIG. 3B than there is between slots 34 and 36 in FIG. 3A. Single head 32*a* is designed so that the slots and pawl mechanisms can be positioned anywhere within single head 32*a*. In some applications, the position of slots and pawl mechanisms can improve the gripping power of the core cable tie due to the fact that, when attached to an object, they conform better to the physical shape of the object and have less material between the cable tie and object.

Figure 3B:
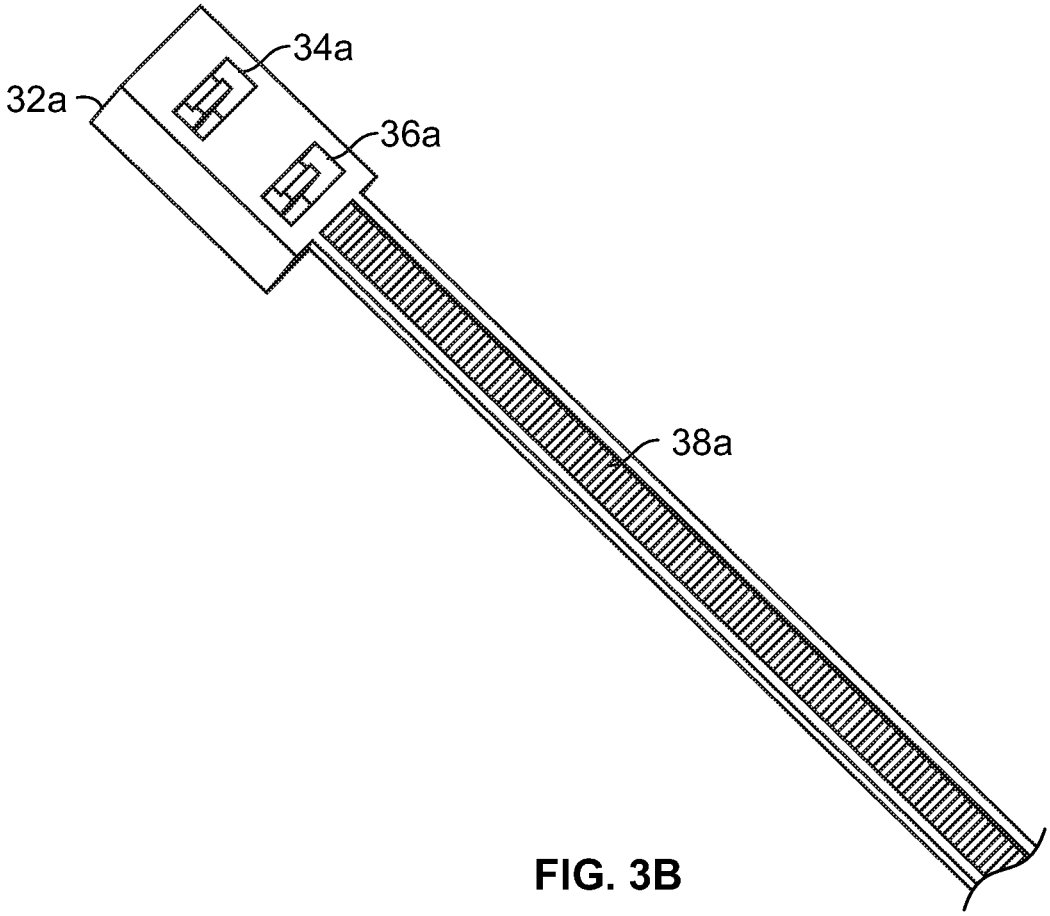
FIG. 3B illustrates a core cable tie with greater spacing between pawl mechanisms.
Figure 3C:
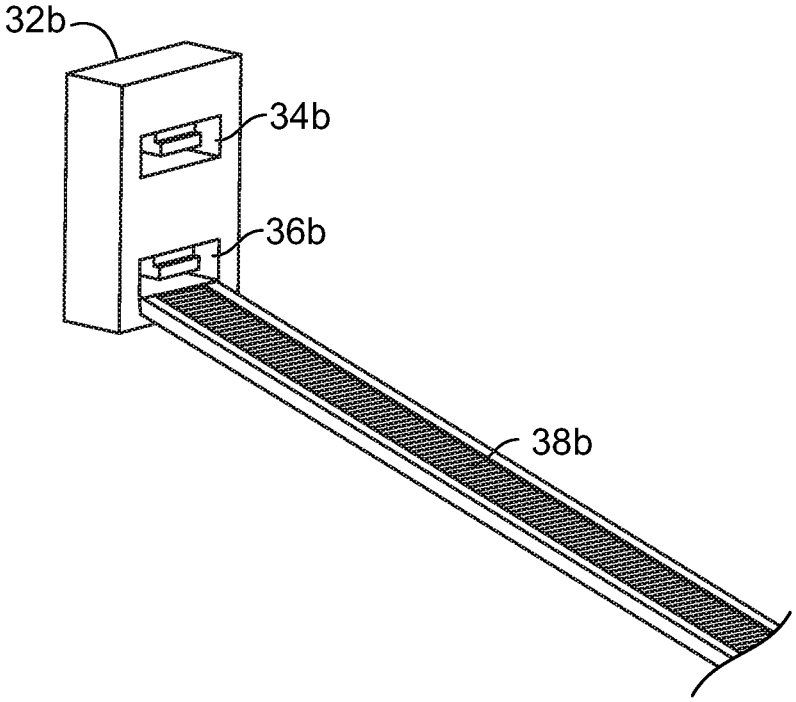
FIG. 3C illustrates a core cable tie with strap attached at a different angle.

FIG. 3C illustrates a core cable tie similar to that shown in FIG. 3A but with the strap 38*b* exiting the head 32*b* in a direction orthogonal to that shown in FIG. 3A. Similarly to FIGS. 3A and 38, slots 34*b* and 36*b* can be located at a variety of positions within head 32*b*.

Figure 2:
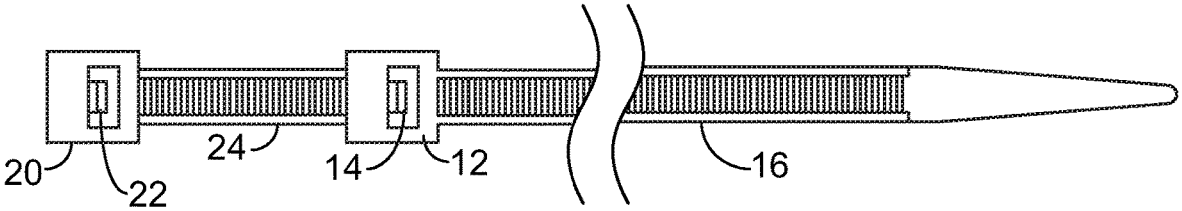
FIG. 2 PRIOR ART
FIG. 2 shows a prior art cable tie with two heads, each having a slot with a pawl mechanism.

Head 32 of FIG. 3A, head 32*a* of FIG. 3B and head 32*b* of FIG. 3C are each formed as a single piece. There is no separate structure, such as the attachment point 24 shown in FIG. 2, to provide a connection between separate heads. In an embodiment, head 32 of FIG. 3A is a solid rectangular prism. As such, all points within head 32, including the region between slots 34 and 36, have strength qualities defined by the solid prism. This maximizes the strength properties of the overall device. Although head 32 is depicted as a rectangular prism in FIG. 3A, a variety of solid shapes could be used such as a generally rectangular prism with rounded corners or an ellipsoid. These merits and attributes are also true for the head 32*a* of FIG. 3B and head 32*b* of FIG. 3C.

Figure 4A:
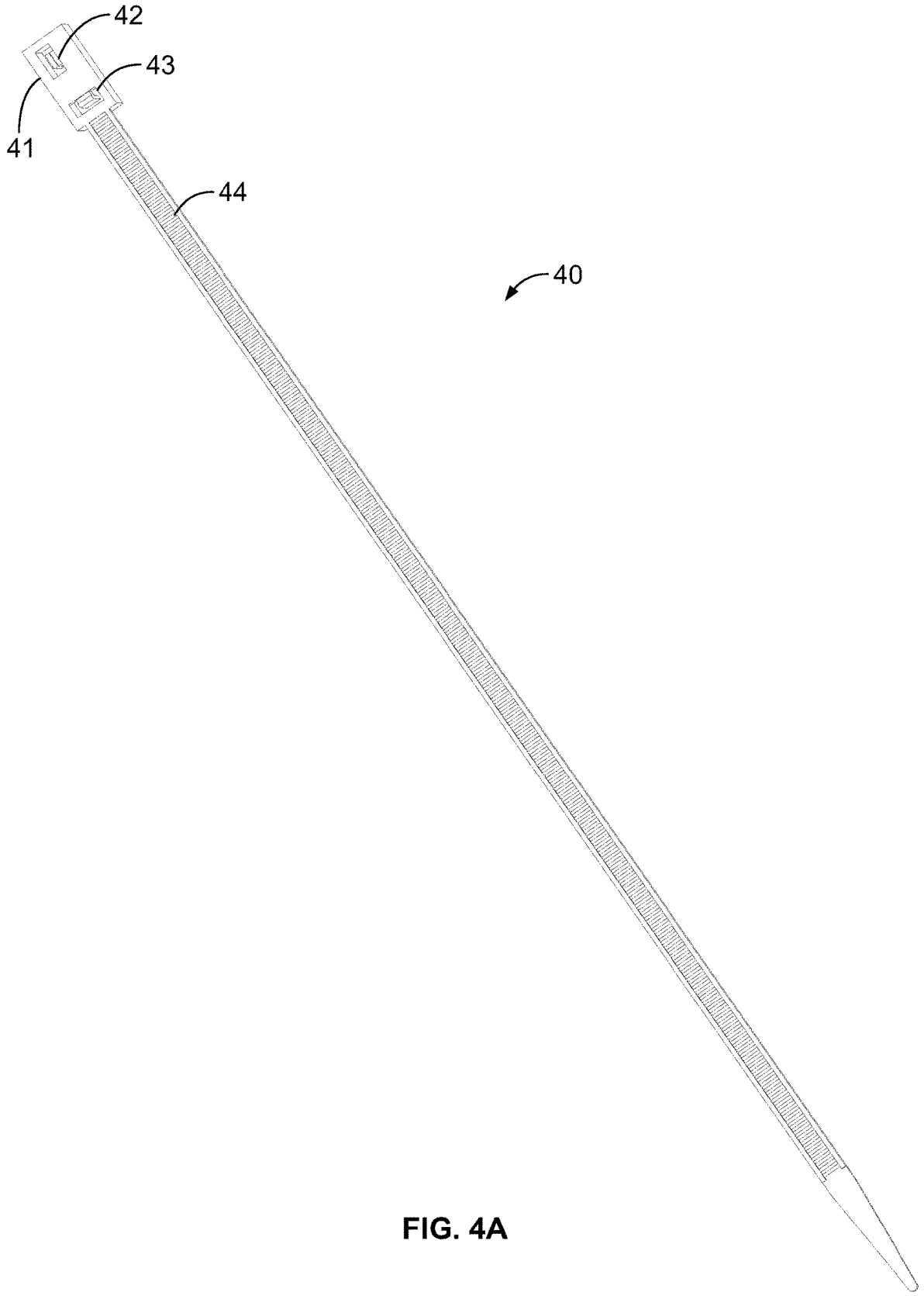
FIG. 4A illustrates a perspective view of an alternative core cable tie.
Figure 4B:
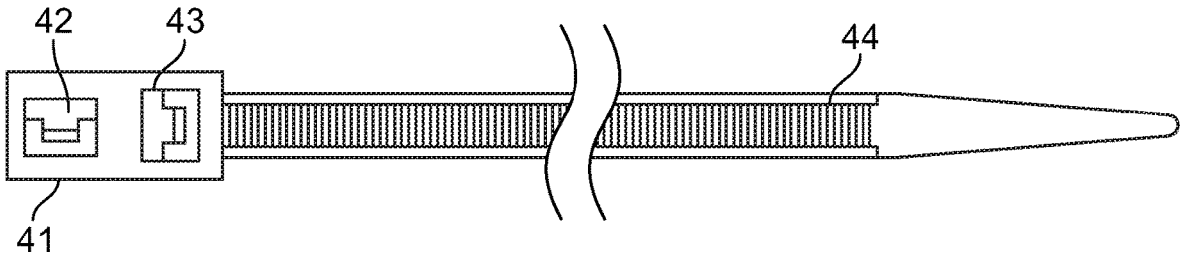
FIG. 4B illustrates top and side views of the embodiment of FIG. 4A.
Figure 4C:
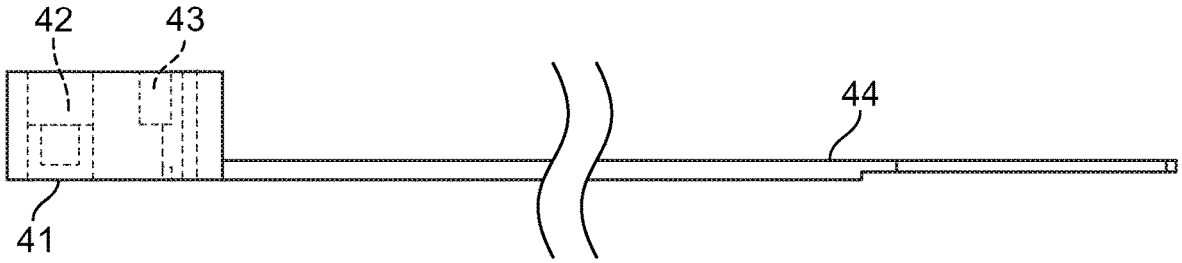
FIG. 4C illustrates a cross section view of the embodiment of FIG. 4B.

In an alternative embodiment, FIG. 4A illustrates core cable tie 40 having a head 41 and a strap 44, wherein slot 42 is rotated 90 degrees from the orientation of slot 34 in FIG. 3A. In this embodiment, slot 43 receives strap 44 as understood by one of ordinary skill in the art. This allows the user to insert an attachment into second slot 42 that is orthogonal to the orientation of the plane formed by inserting strap 44 into slot 43. The solid rectangular prism of head 41 is similar to that of FIG. 3, and has the same strength advantages. Top and side views of the embodiment of FIG. 4A are shown in FIGS. 4B and 4C. Equivalent elements are shown with the same reference numbers.

Figure 5A:
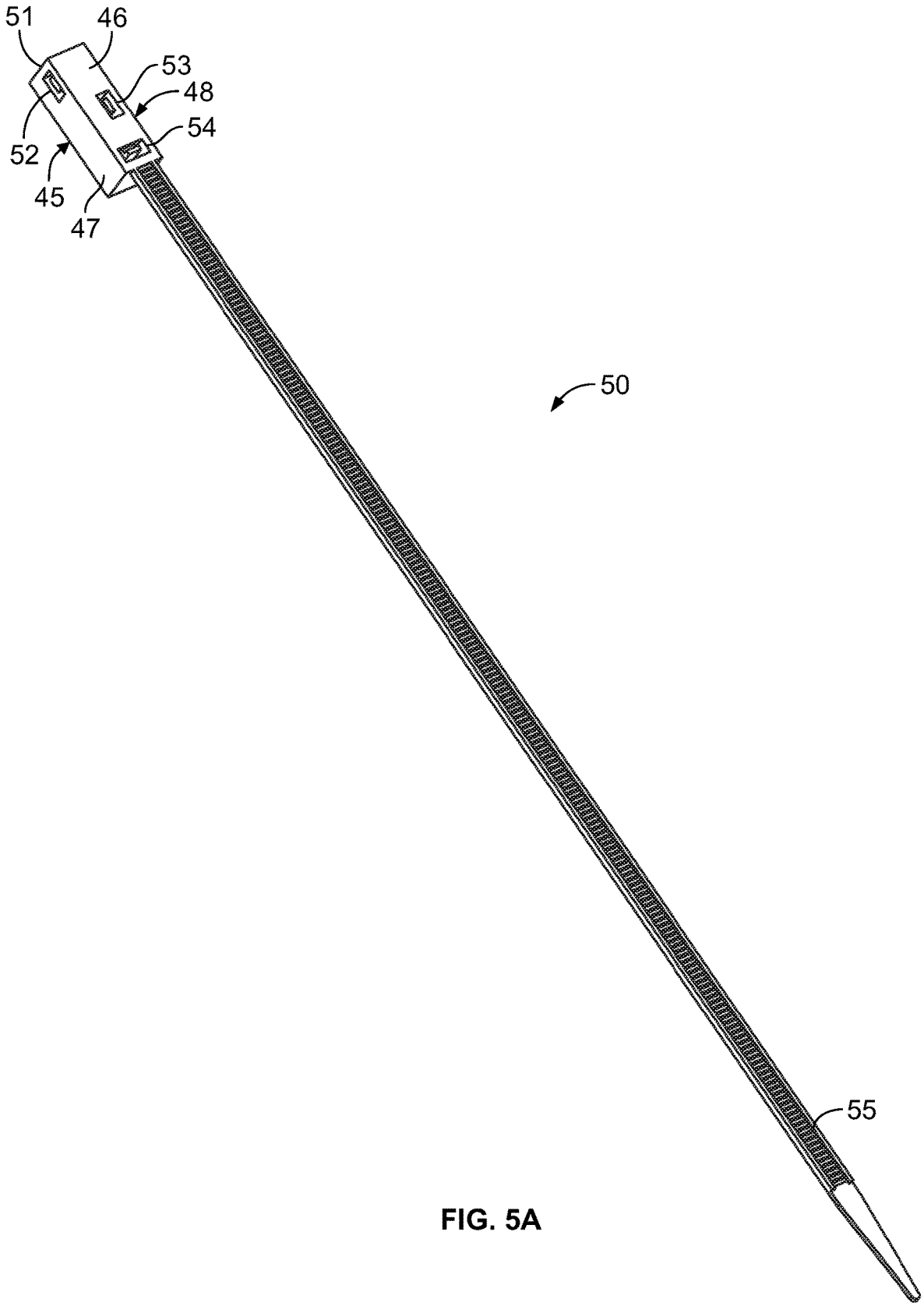
FIG. 5A illustrates a perspective view of an alternative core cable tie with three slots having pawl mechanisms.

FIG. 5A shows a further embodiment of a core cable tie according to the present invention. Cable tie 50 of FIG. 5A features a single head 51 with three slots 52, 53 and 54 each incorporating a pawl mechanism similar to pawls 35 and 37 of FIG. 3A. Each slot has a different orientation. Slot 54 is similar to slot 36 of FIG. 3A, with openings in opposing faces 45 and 46 of head 51 so as to receive an end of strap 55. Slot 53 is rotated 90 degrees from the orientation of slot 54, and also has openings in faces opposing 45 and 46 of head 51. Slot 52 is rotated 90 degrees in a lengthwise direction from slot 53 so open ends of slot 52 are in opposing faces 47 and 48 of head 51. The rectangular shape of head 51 is similar to the head of FIG. 3A and thus, it retains the same strength advantages. As noted above, although head 51 is depicted as a rectangular prism in FIG. 5A, a variety of solid shapes could be used such as a generally rectangular prism with rounded corners or an ellipsoid.

Figure 5B:
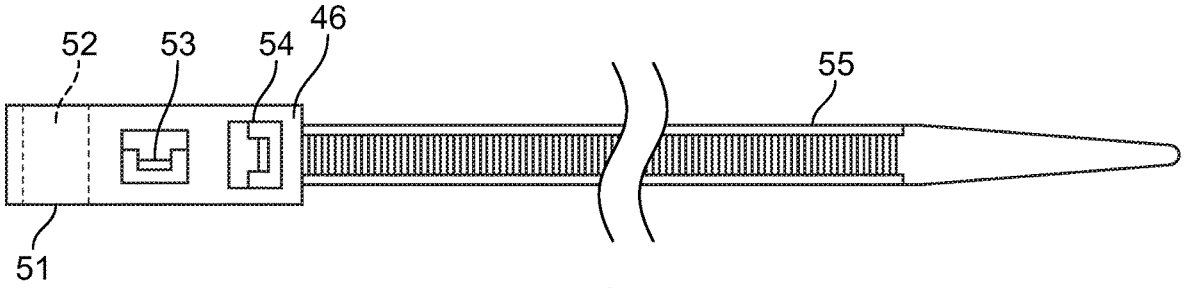
FIG. 5B illustrates top view of the embodiment of FIG. 5A
Figure 5C:
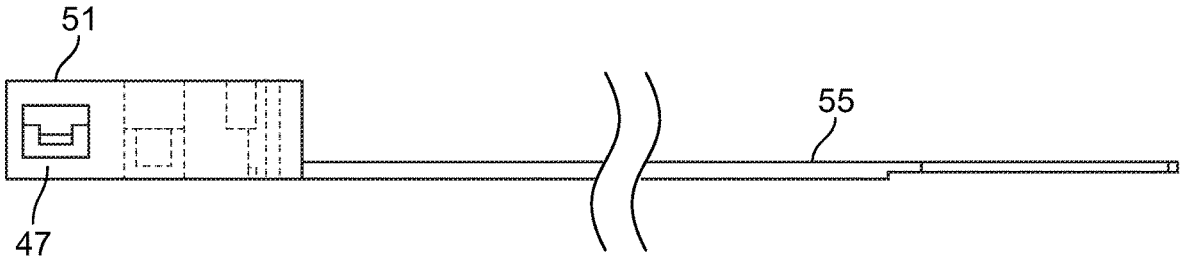
FIG. 5C illustrates a cross-sectional side view of the embodiment of FIG. 5B.

FIGS. 5B and 5C show top and side views of the embodiment of FIG. 5A. Although specific orientations are shown in FIGS. 5A-C, slots 52 and 53 may each have a variety of orientations. For example, slot 52 may be rotated 90 degrees while its open ends remain in faces 47 and 48, or slot 53 may be rotated 90 degrees in a lengthwise direction so that its open ends are in faces 47 and 48 instead of 45 and 46. Equivalent elements in FIGS. 5B and 5C are shown with the same reference numbers as in FIG. 5A.

Figure 6A:
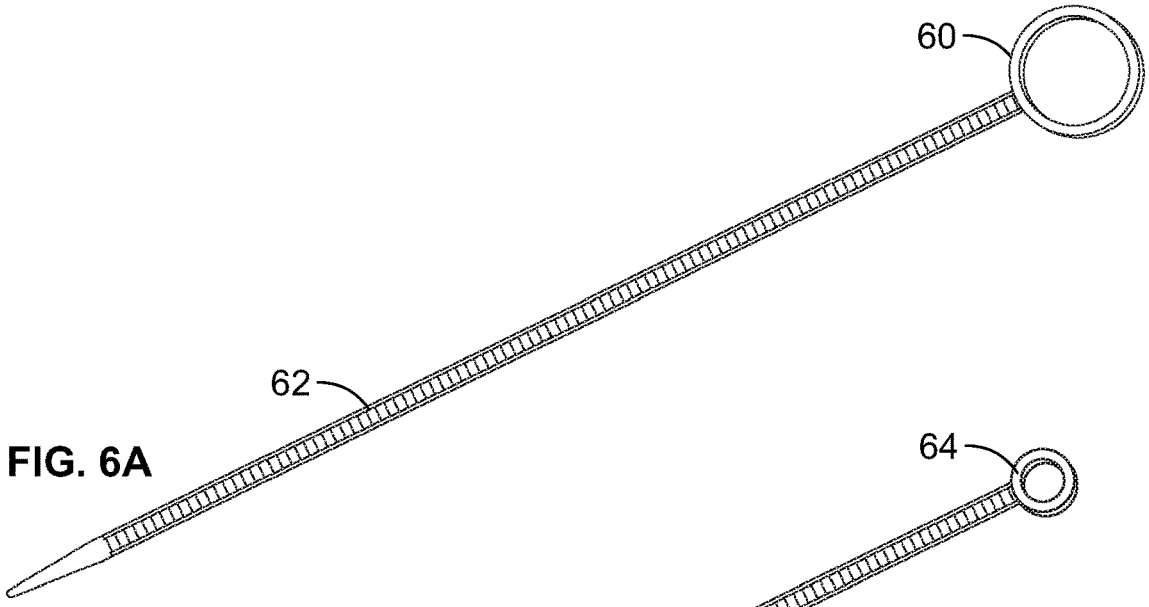
FIGS. 6A-6G illustrate various embodiments of attachments that can be used with the core cable ties of FIGS. 3A-3C, 4A-4C and 5A-5C.

In all of the above embodiments, core cable tie 30, 40 or 50 is generally attached to an object using strap 38, 44 or 55 inserted into one of the slots containing a pawl mechanism, as would be understood by one of ordinary skill in the art. Other slots in the head of a core cable tie form an interface to attach additional devices having notched straps that mate with the pawls' ratcheting action thus forming a cable tie assembly. FIGS. 6A 6G show several attachments that can be inserted into unused or available slots and thus provide increased functionality to a core cable tie.

FIG. 6A shows a ring pull attachment having a ring pull head 60 and a strap 62 for insertion into a slot, for example, slot 34 of FIG. 3A. In an embodiment, ring pull head 60 is approximately 1 inch in diameter but any preferred diameter could be used.

Figure 6B:
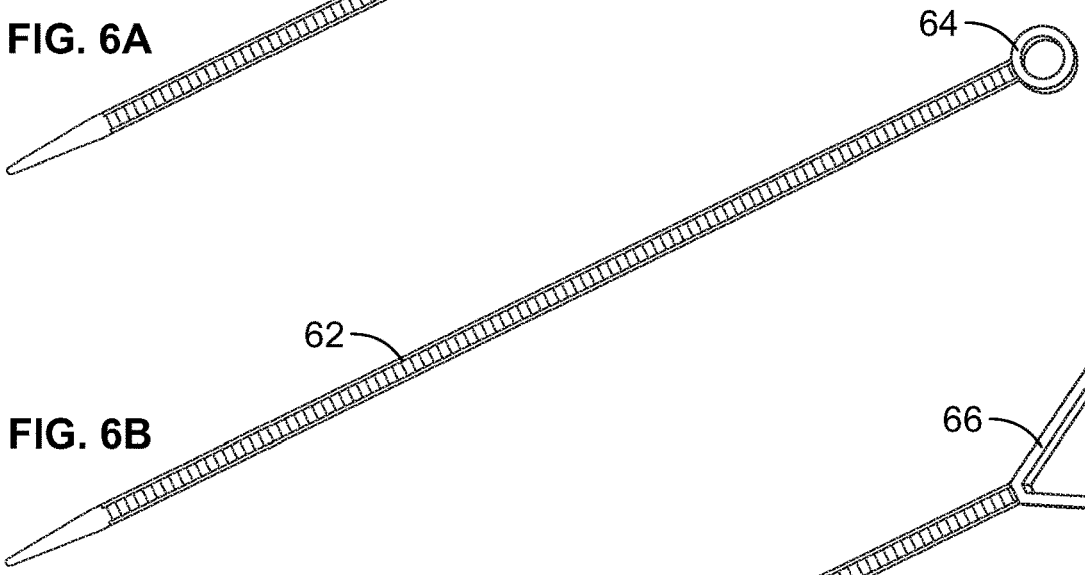

FIG. 6B shows a nail/screw attachment having head 64 attached to strap 62. In an embodiment, head 64 is approximately ⅛ to ¼ inches in diameter but any preferred diameter could be used. Ideally, head 64 is sized to be large enough to receive the shaft of a nail or screw but small enough to prevent the head of the nail or screw from passing through. In a further embodiment, head 64 is used as an attachment point for other devices. A carabineer, for example, could be placed though the hole. For this embodiment, head 64 is approximately 0.5 inches in diameter but any preferred diameter could be used.

Figure 6C:
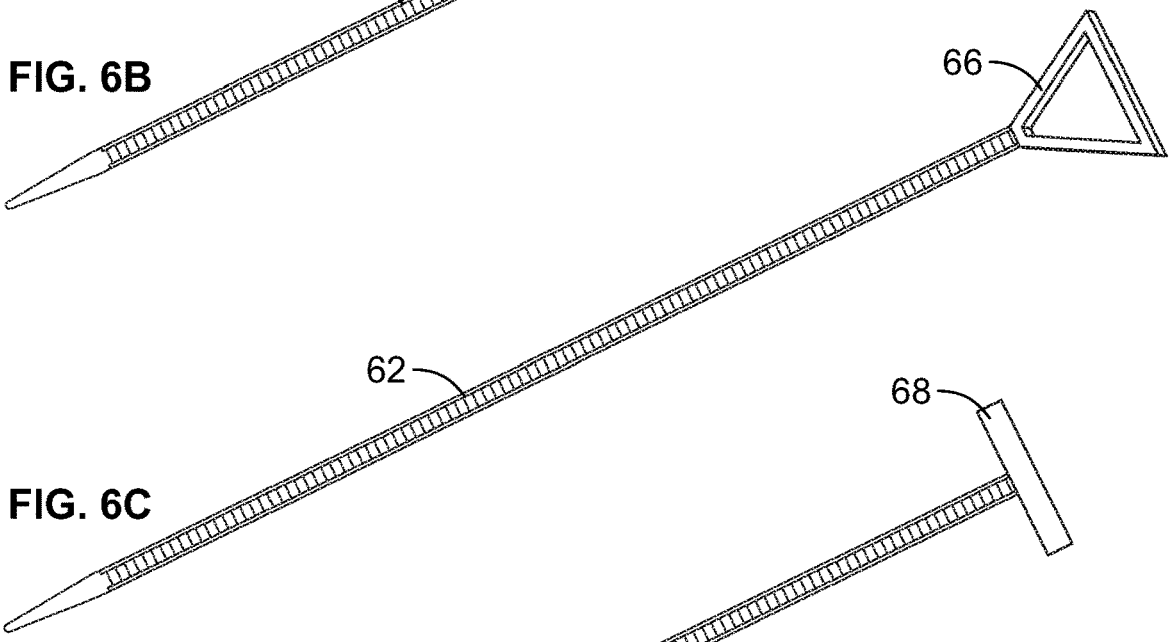

FIG. 6C shows an attachment similar to that of FIG. 6A but instead head 66 has a triangular shape. This allows an object attached to the core cable tie to be lifted with multiple fingers or possibly an entire hand. A variety of dimensions could be used for head 66, for example, from 1 to 4 inches across.

Figure 6D:
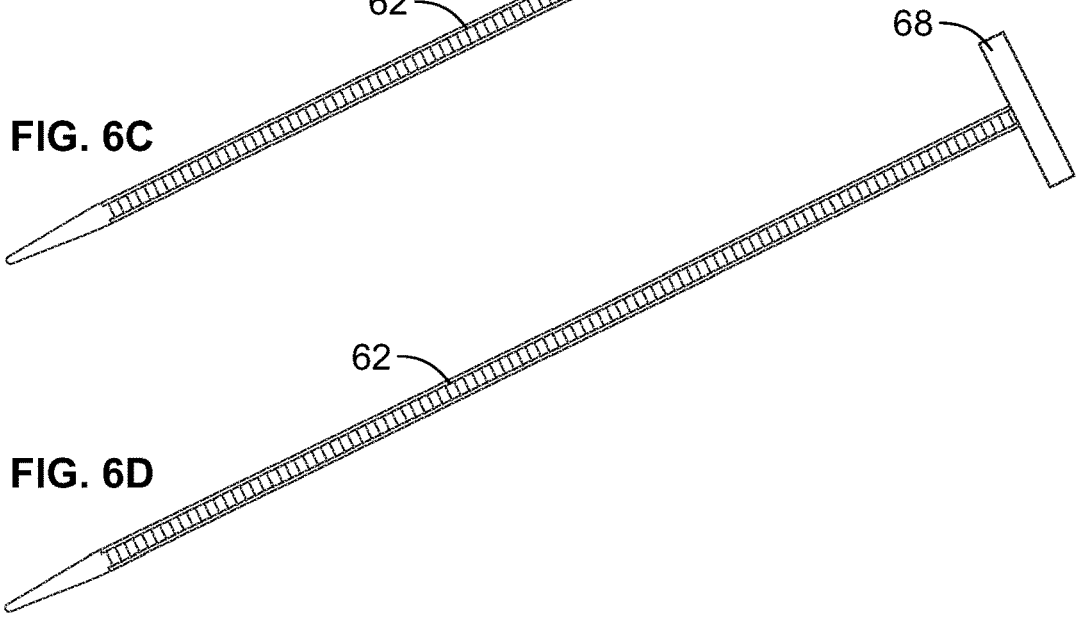

FIG. 6D shows an attachment similar to that of FIG. 6C but instead head 68 has a T-shape as shown. This attachment is used similarly to the attachments of FIGS. 6A and 6C, such that it provides a means for grasping the cable tie assembly. In an embodiment, head 68 is between approximately 3 and 5 inches wide, but any preferred dimension could be used. As depicted, head 68 is generally flat, but it could also have a circular, triangular or other cross-sectional shape.

Figure 6E:
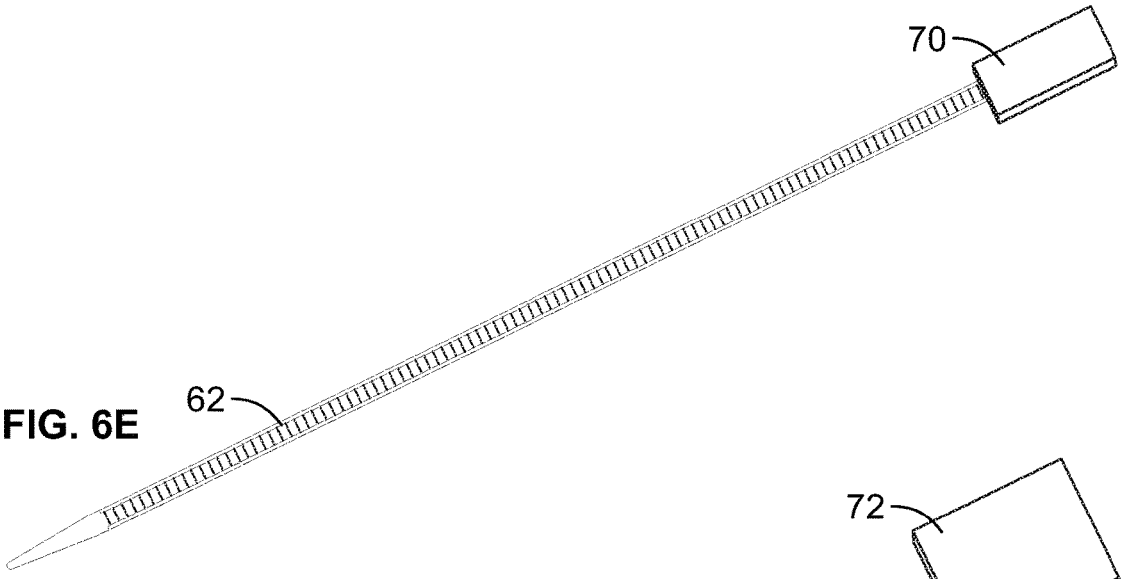

FIG. 6E shows a version of an attachment having a head 70 designed for attachment to other structures. The head can be flat or curved to mate with the surface of the structure. In this embodiment, nails, screws or staples are driven though head 70 and into the structure. Examples of structures include wooden beams, trees, or walls. Head 70 has dimensions of approximately 1 inch long and 0.5 inches wide. The size and shape of the head 70 can be changed based on the attachment needs for an application. Glue or adhesive can be applied to the head 70 in lieu of or to augment the use of nails, screws or staples.

Figure 6F:
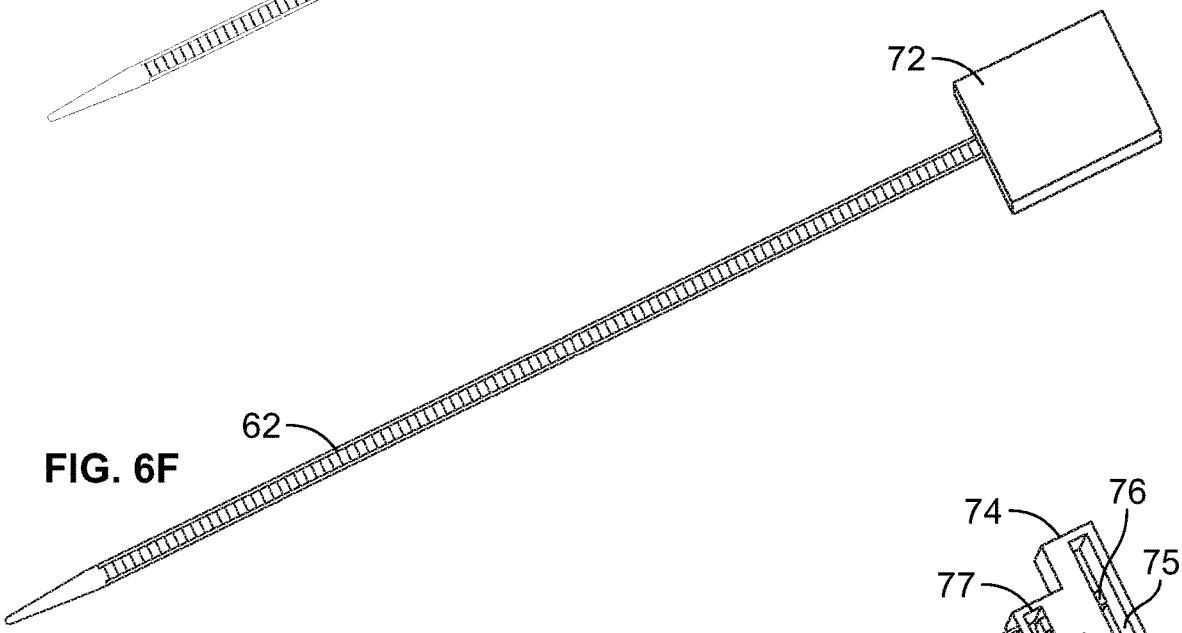
Figure 6G:
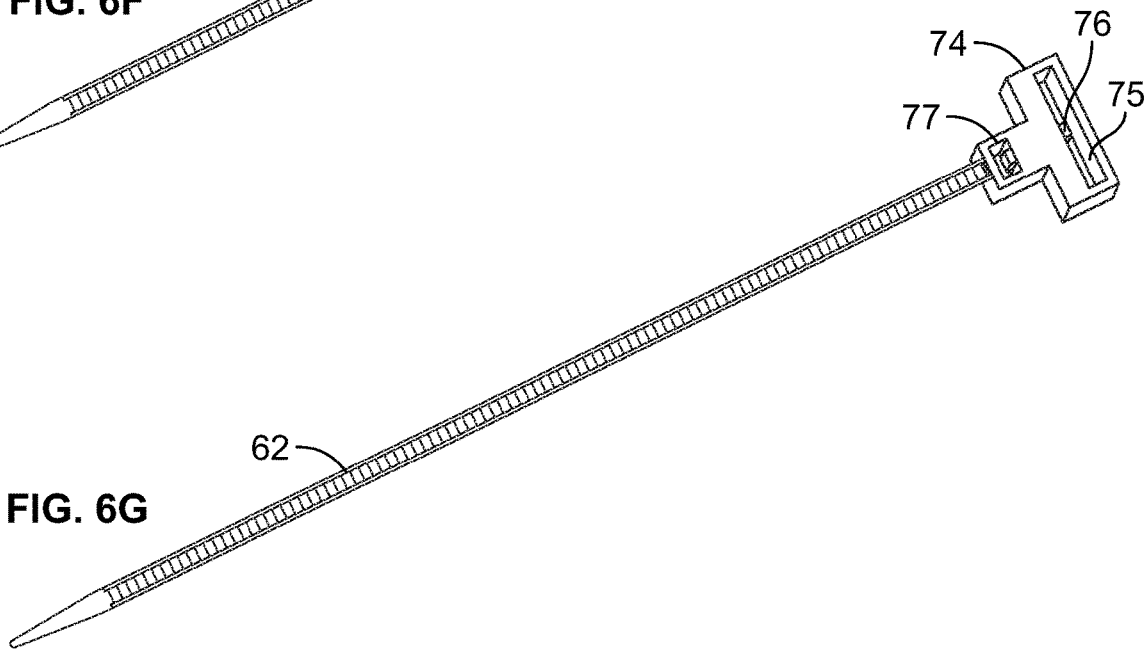

FIG. 6F shows a version of an attachment having a head 72 for labeling. Embodiments include the use of handwritten or pre-printed labels. In an embodiment, head 72 is covered or coated with paper, for example, to make writing easier. Head 72 has dimensions of approximately 1 inch long and 2 inches wide. The size and shape of the head 72 can be changed based on the labeling needs for an application. Head 72 is also capable of being used with nails, screws or staples as explained above for FIG. 6E.

FIG. 6G shows a version of an attachment that provides an additional mounting point for a cable tie that does not have the same slot and pawl mechanism requirement for the attachment strap 62. Head 74 includes a slot 75 incorporating a pawl mechanism 76 that is designed to receive cable ties with a strap having a different width and/or thickness from that of strap 62. Head 74 allows other cable tie designs or confirmations to be coupled to the attachment. In an embodiment, head 74 also incorporates a slot 77 and accompanying pawl mechanism to accept the strap 62 or others similar to those shown in FIGS. 3-5.

All of the attachments of FIGS. 6A-6G use a notched strap 62 to connect to a slot using a pawl mechanism in the slot. Attachment strap 62 contains the mating surface to any of slots 34, 34*a*, 34*b*, 36, 36*a*, 36*b*, 42, 43, 52, 53 or 54. It is inserted into a slot and held in place by ratcheting surfaces in a similar way to that of strap 38 when inserted into slot 36 of FIG. 3A, for example. The functional element, or head, of a chosen attachment defines the function of the overall cable tie assembly.

Figure 7A:
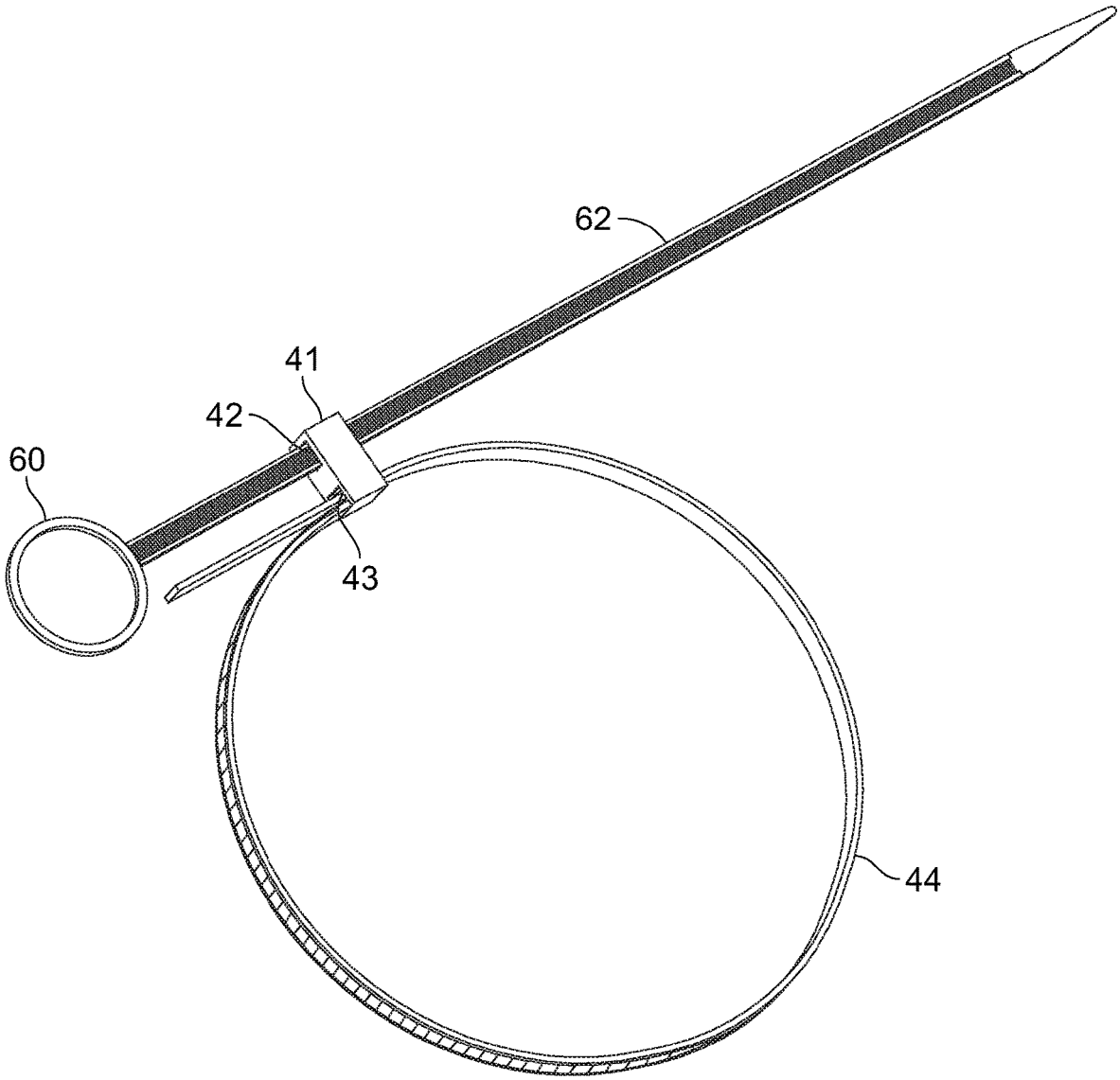
FIGS. 7A-7D illustrate an embodiment of the present invention that combines variations of the core cable tie of FIG. 4 with the attachment of FIG. 6A.
Figure 7B:
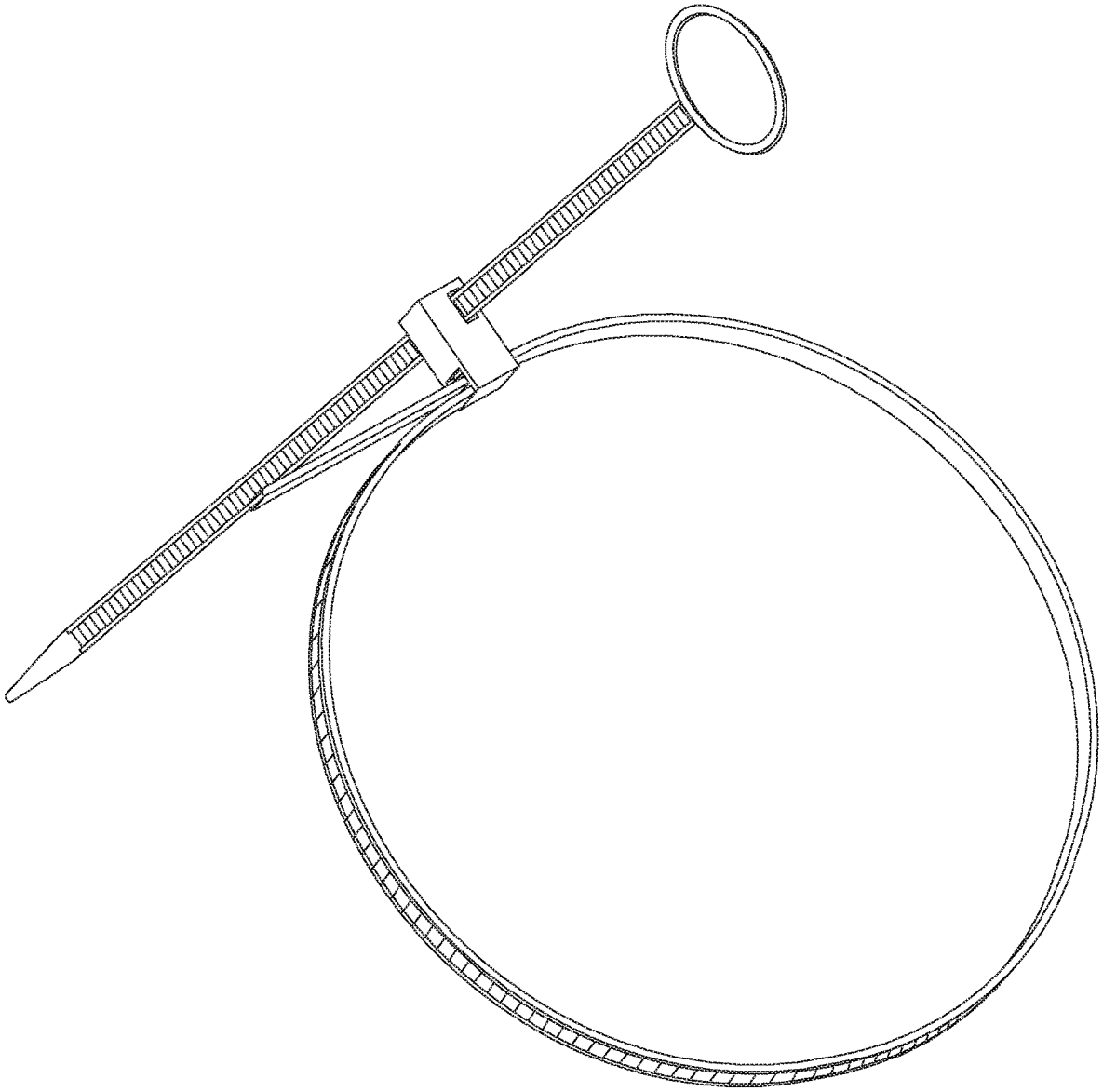
Figure 7C:
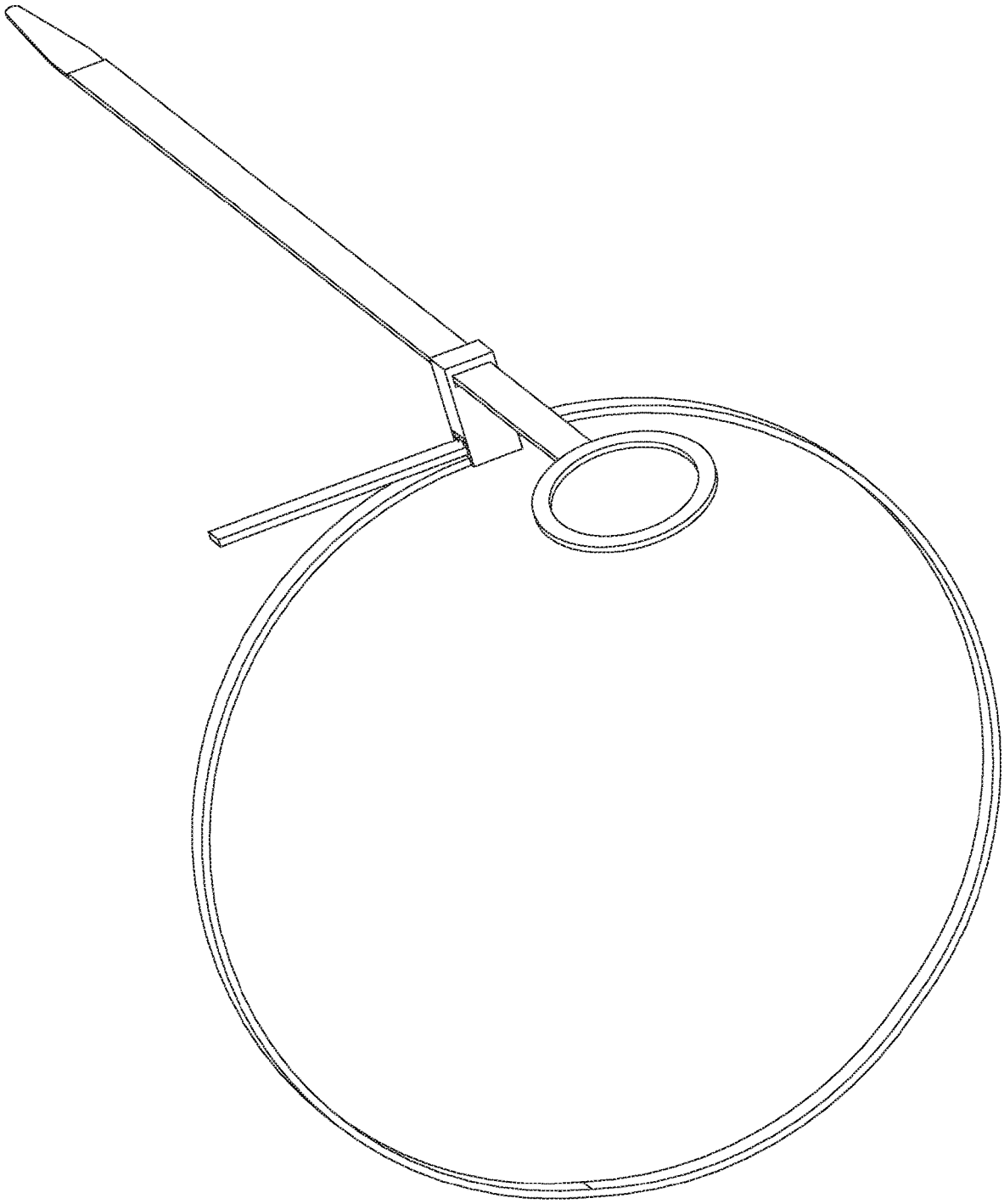
Figure 7D:
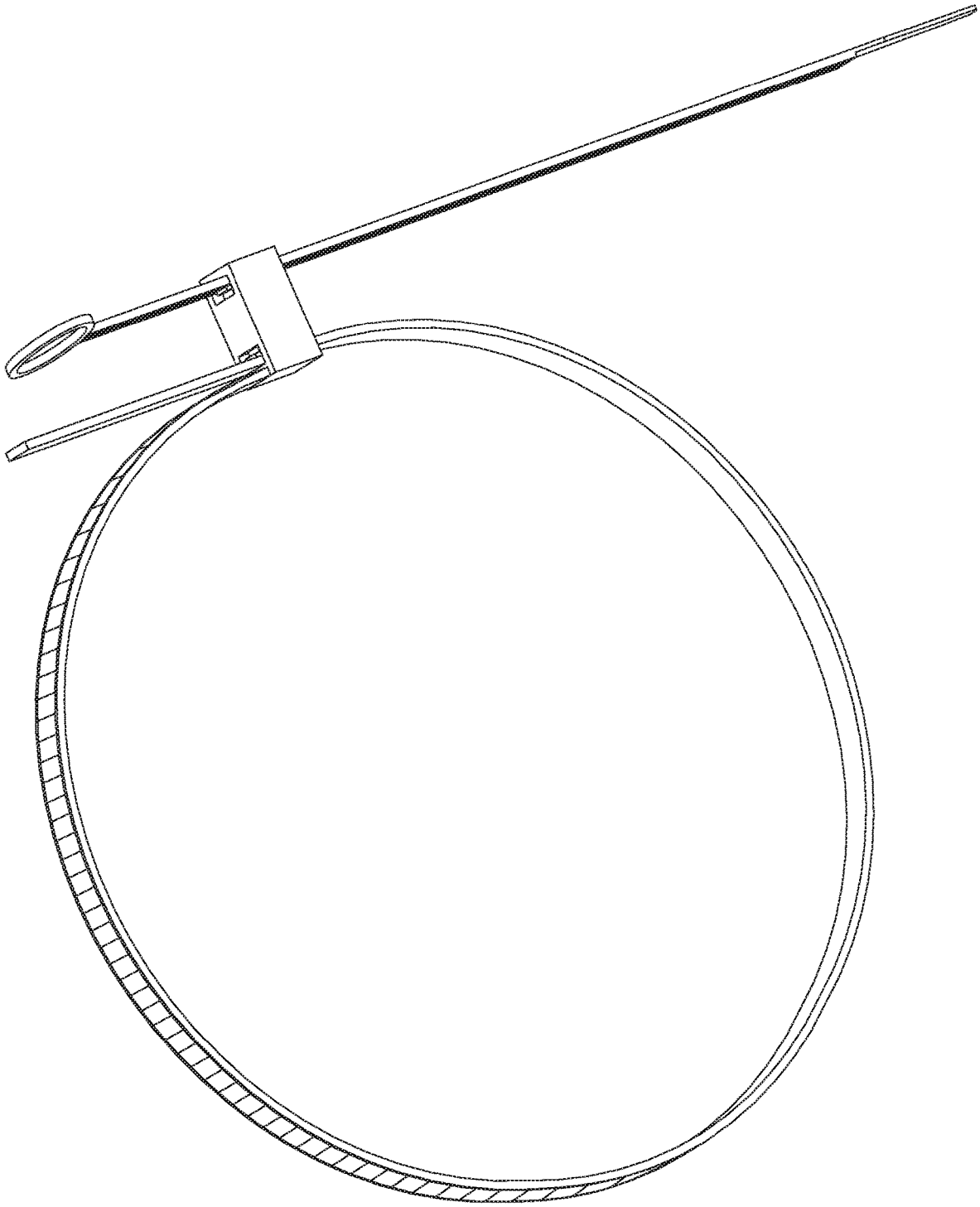

FIG. 7A illustrates a representative embodiment of a cable tie assembly according to the present invention featuring the core cable tie of FIG. 4A and the ring pull attachment of FIG. 6A. In FIG. 7A, the end of the strap 44 is passed around another object (not shown) then inserted into slot 43 of head 41. Strap 62 of the ring pull attachment is inserted into slot 42 of head 41. Here slot 43 used for the strap 44 is orthogonal to the slot 42 used for the ring pull attachment. Although a specific embodiment has been shown, any of the core cable ties of FIGS. 3-5 and attachments of FIG. 6 could be combined in a manner similar to that shown in FIG. 7A. FIGS. 7B, 7C and 7D illustrate embodiments of cable tie assemblies with variations in slot positions within the single head of the cable tie.

Figure 8:
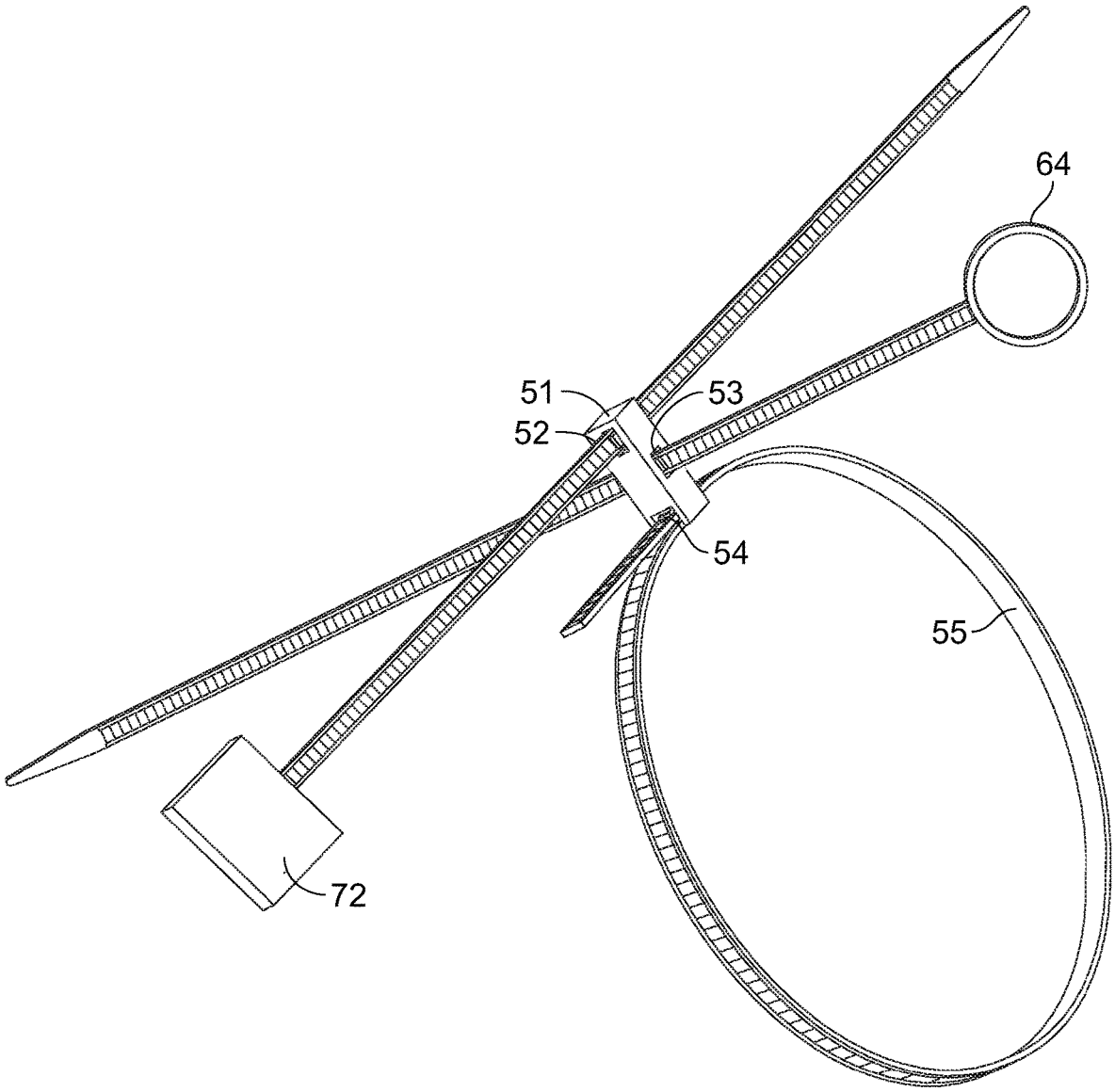
FIG. 8 illustrates an embodiment of the present invention that combines the core cable tie of FIG. 5 with the attachments of FIGS. 6A and 6F.

FIG. 8 illustrates yet a further embodiment of a cable tie assembly according to the present invention. In this figure, cable tie 50 of FIG. 5A is attached to the flat plate attachment of FIG. 6F through slot 52 in head 51 and is further attached to the nail/screw attachment of FIG. 6B through slot 53 in head 51. Slot 54 is used with strap 55 to attach the cable tie assembly to an item or structure. In another embodiment, the cable tie assembly of FIG. 8 can be attached to another core cable tie by means of strap 55, which is inserted into a slot of another cable tie.

Figure 9A:
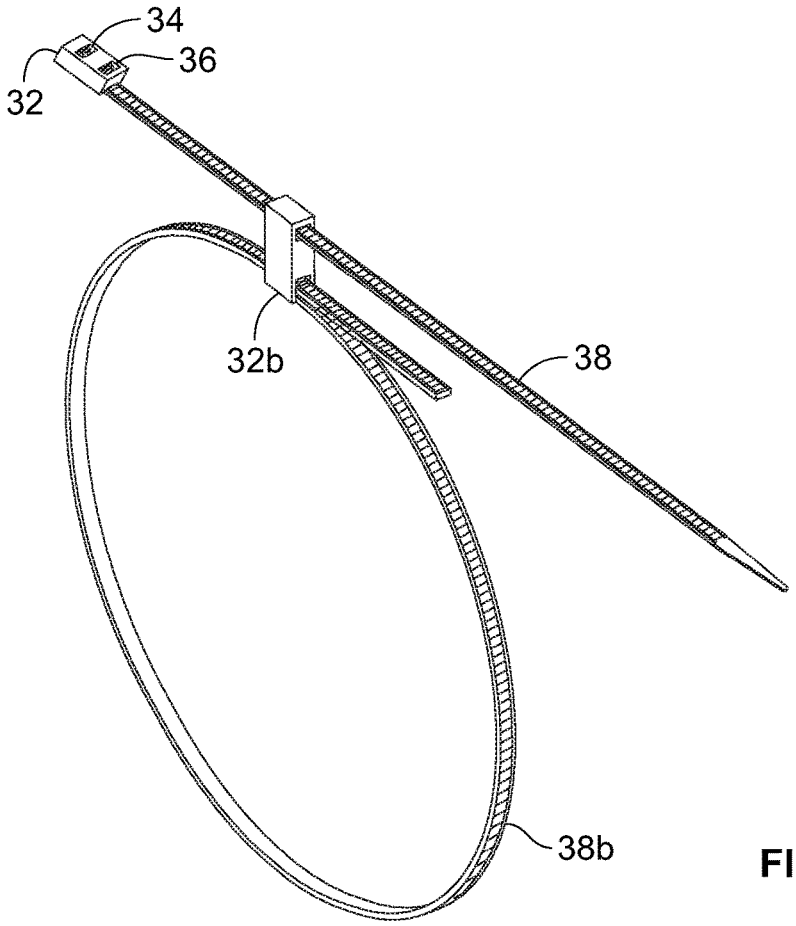
FIG. 9A illustrates an embodiment where two core cable ties are combined in a cable tie assembly and form multiple attachment points for attachments of FIGS. 6A-6G.

FIG. 9A illustrates how one could generate multiple attachment points similar to that shown in FIG. 8 using the core cable tie of FIG. 3C. Strap 38*b* is inserted in a slot in head 32*b*. It is assumed that cable tie strap 38*b* is secured to an object. Also shown is cable tie 30 from FIG. 3A having it's strap 38 inserted into the remaining slot in head 32*b*. Slots 34 and 36 in head 32 are available to receive attachment devices such as those described in FIGS. 6A-6G or additional cable ties.

Figure 9B:
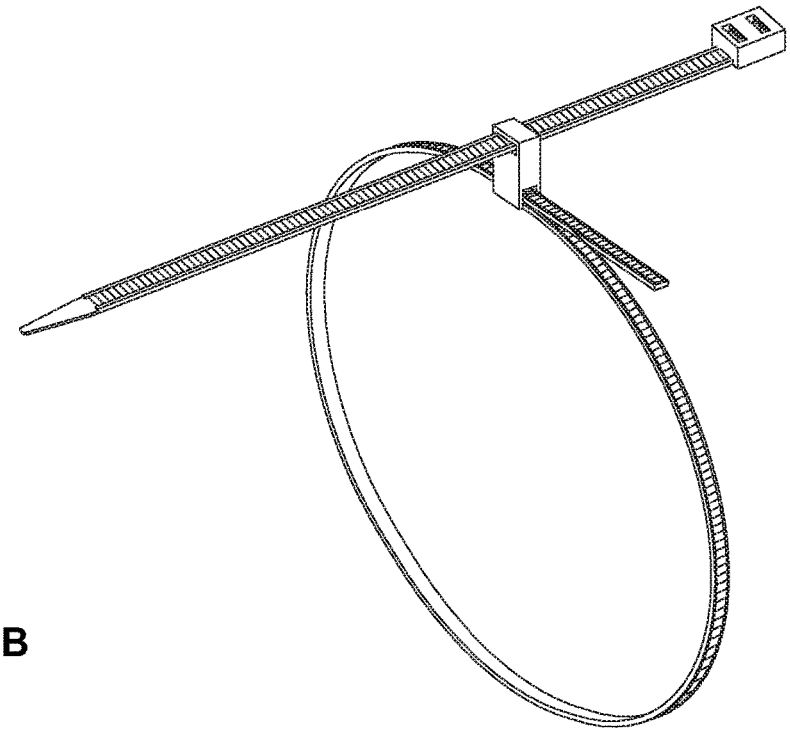
FIGS. 9B, 9C and 9D illustrate variations of the embodiment of FIG. 9A.
Figure 9C:
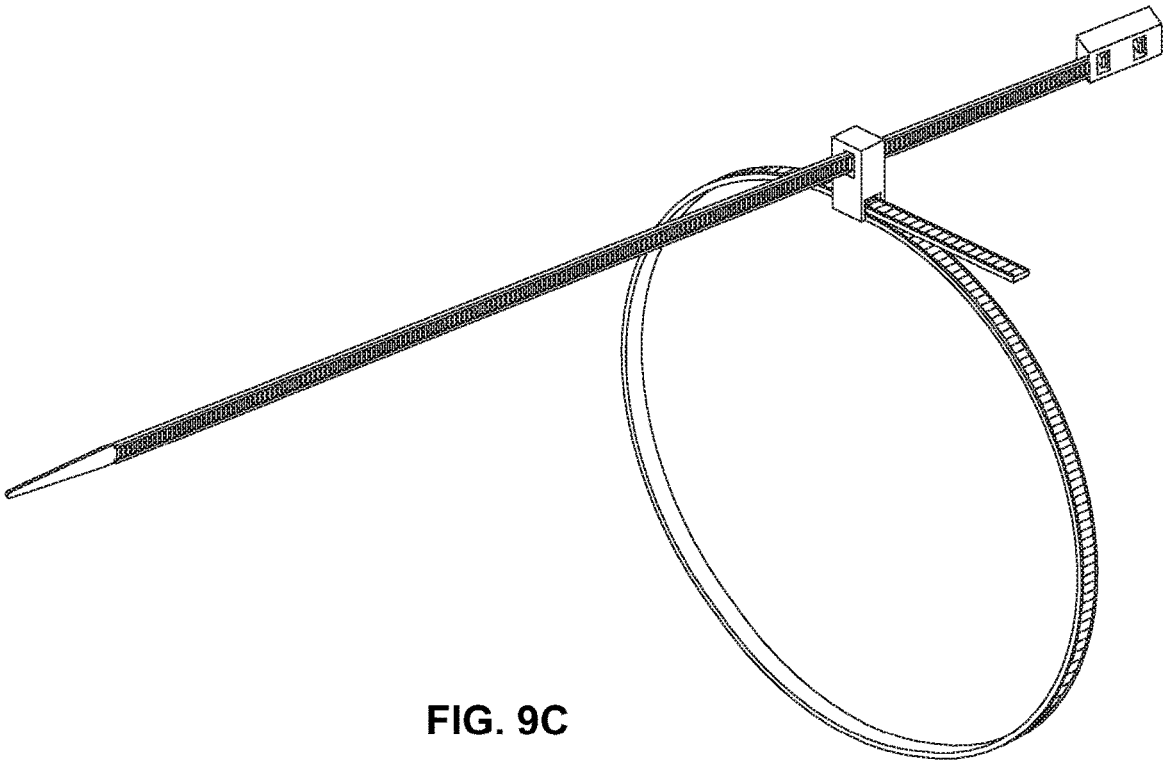
Figure 9D:
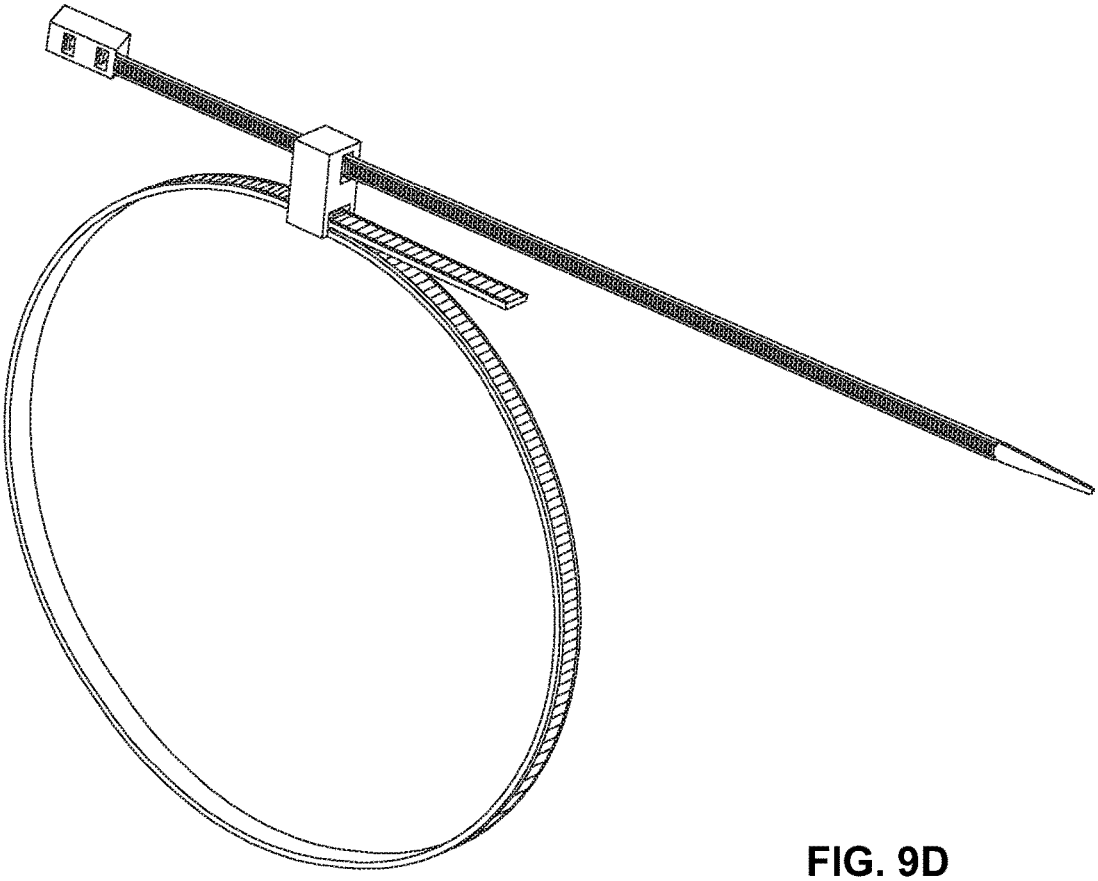

FIGS. 9B, 9C and 9D illustrate how the locations of the slots and pawl mechanisms within head 32*b* can be changed to provide a range of orientations for the assembled devices. While these illustrations show rotations in 90 degree intervals, any possible rotation is possible. The shape of bead 32*b* is not limited to a cubic design but could be other shapes to include cylindrical.

Although specific attachments and cable ties have been shown, any of the embodiments of FIGS. 3-6 could be combined to form an assembly that meets a particular need. The current invention allows a wide variety of uses with the flexible combination of individual components. In particular, a defined set of core cable ties and attachments can be combined in a wide variety of ways, allowing great flexibility in configurations and use with a relatively small assortment of devices.

Any of the cable ties or attachments of the above embodiments are fabricated using an injection molding process, for example. This can be done by forcing a material such as a liquid thermoplastic or thermosetting polymer into a mold cavity, where it cools and hardens to the configuration of the cavity.

The cable tie of the present invention has a range of commercial and military applications. From the military perspective, it could be used to attach field equipment to other structures, e.g. antenna to a building. It could also be used to attach tools and equipment to individuals or their Improved Load Bearing Equipment/Rucksack as well as to carry objects that have no inherent handle, for example, lifting/moving drums and containers, opening containers (especially when dexterity is lost from being in Mission Oriented Protective Posture or wearing gloves). The cable tie has applicability to a wide range of field expedient measures, for example, making shelters and emergency devices and structures that normally require rope and lashing skills.

Numerous alternative implementations of the present invention exist. Dimensions can be varied according to the desired end use. Attachment heads like those of FIGS. 6A-6G could also take different shapes, both closed and open.

The apparatus 100 in one example comprises any (e.g., horizontal, oblique, or vertical) orientation, with the description and figures herein illustrating one example orientation of the apparatus 100, for explanatory purposes.

The steps or operations described herein are just for example. There may be many variations to these steps or operations without departing from the spirit of the invention. For instance, the steps may be performed in a differing order, or steps may be added, deleted, or modified.

Although example implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A cable tie, comprising:

an elongated strap having a length, a width and a thickness, said strap further comprising a plurality of longitudinally-spaced teeth along a surface of said strap; and a head integrally formed with said strap, said head formed of a solid shape having a length orthogonal or substantially orthogonal to a longitudinal axis of the strap so that said head is orthogonal or substantially orthogonal to the strap, and a width and a thickness larger than the width and the thickness of the strap, and said head further including two or more slots positioned in any orientation through the width or the thickness of said head, each slot further comprising a pawl for cooperating with said teeth when said strap is inserted into said slot.

2. The cable tie of claim 1, wherein said two or more slots positioned in any orientation comprise a first slot and a second slot rotated 90 with respect to each other.

3. The cable tie of claim 1, wherein said two or more slots positioned in any orientation comprise a first slot and a second slot parallel with respect to each other.

4. The cable tie of claim 1, wherein said two or more slots positioned in any orientation comprise a first slot and a second slot, wherein both slots are through the width of said head.

5. The cable tie of claim 1, wherein said two or more slots positioned in any orientation comprise a first slot and a second slot, wherein both slots are through the thickness of said head.

6. The cable tie of claim 1, wherein said two or more slots positioned in any orientation comprise a first slot and a second slot, wherein one slot is through the width of said head and the other slot is through the thickness of said head.

7. The cable tie of claim 1, wherein said two or more slots positioned in any orientation comprise a first slot, a second slot, and a third slot, wherein each of said second slot and said third slot are rotated 90° with respect to said first slot.

8. A cable tie assembly, comprising:

an elongated strap having a length, a width and a thickness, said strap further comprising a plurality of longitudinally-spaced teeth along a surface of said strap;

a head integrally formed with said strap, said head formed of a solid shape having a length orthogonal or substantially orthogonal to a longitudinal axis of the strap so that said head is orthogonal or substantially orthogonal to the strap, and a width and a thickness larger than the width and the thickness of the strap, and said head further including two or more slots positioned in any orientation through the width or the thickness of said head, each slot further comprising a pawl for cooperating with said teeth when said strap is inserted into said slot; and an attachment comprising an attachment strap having a length, a width and a thickness, said attachment strap further comprising a plurality of longitudinally-spaced teeth along a surface of said attachment strap, said attachment further comprising a functional element attached to said attachment strap, said attachment strap adapted for insertion into any one of said two or more slots in said head such that the pawl in the slot cooperates with the teeth on the attachment strap.

9. The cable tie assembly of claim 8, wherein the functional element is a ring pull.

10. The cable tie assembly of claim 8, wherein the functional element is a nail or screw attachment.

11. The cable tie assembly of claim 8, wherein the functional element is a triangular shaped handle.

12. The cable tie assembly of claim 8, wherein the functional element is a T-shaped handle.

13. The cable tie assembly of claim 8, wherein the functional element is a flat plate.

14. The cable tie assembly of claim 13, wherein the flat plate has dimensions of about 1 inch×1 inch or about 1 inch by 2 inch.

15. The cable tie assembly of claim 8, wherein said two or more slots positioned in any orientation comprise a first slot and a second slot rotated 90° with respect to each other.

16. The cable tie assembly of claim 8, wherein said two or more slots positioned in any orientation comprise a first slot and a second slot parallel with respect to each other.

17. The cable tie assembly of claim 8, wherein said two or more slots positioned in any orientation comprise a first slot and a second slot, wherein both slots are through the width of said head.

18. The cable tie assembly of claim 8, wherein said two or more slots positioned in any orientation comprise a first slot and a second slot, wherein both slots are through the thickness of said head.

19. The cable tie assembly of claim 8, wherein said two or more slots positioned in any orientation comprise a first slot and a second slot, wherein one slot is through the width of said head and the other slot is through the thickness of said head.

20. The cable tie assembly of claim 8, wherein said two or more slots positioned in any orientation comprise a first slot, a second slot, and a third slot, wherein each of said second slot and said third slot are rotated 90° with respect to said first slot.

* * * * *